United States Patent [19]

Kunimune et al.

[11] 4,323,626

[45] * Apr. 6, 1982

[54] HEAT-ADHESIVE COMPOSITE FIBERS

[75] Inventors: Kohichi Kunimune, Moriyamashi; Teruaki Hane, Shigaken; Seigo Inadomi, Monyamashi; Yasuhiko Furukawa, Kusatsushi, all of Japan

[73] Assignee: Chisso Corporation, Osaka, Japan

[ * ] Notice: The portion of the term of this patent subsequent to Nov. 18, 1997, has been disclaimed.

[21] Appl. No.: 188,302

[22] Filed: Sep. 18, 1980

Related U.S. Application Data

[63] Continuation-in-part of Ser. No. 62,814, Aug. 1, 1979, Pat. No. 4,234,655, which is a continuation-in-part of Ser. No. 31,989, Apr. 20, 1979, abandoned, which is a continuation of Ser. No. 842,660, Oct. 11, 1977, abandoned.

[30] Foreign Application Priority Data

| | | | |
|---|---|---|---|
| Oct. 20, 1976 | [JP] | Japan | 51/125723 |
| Dec. 13, 1976 | [JP] | Japan | 51/149597 |
| Apr. 12, 1977 | [JP] | Japan | 52/41685 |

[51] Int. Cl.[3] ..... D02G 3/00

[52] U.S. Cl. ..... 428/374; 428/221; 428/296; 428/359; 428/373

[58] Field of Search ..... 428/373, 374, 375, 370, 428/394, 359, 221, 224, 296; 264/171

[56] References Cited

U.S. PATENT DOCUMENTS

| | | | |
|---|---|---|---|
| 3,163,492 | 12/1964 | Thomas | 260/32.6 PQ |
| 3,245,930 | 4/1966 | McDowell et al. | 260/28.5 A |
| 3,422,055 | 1/1969 | Maloney | 260/42.46 |
| 3,433,573 | 3/1969 | Holladay et al. | 8/169 |
| 3,511,747 | 5/1970 | Davies | 156/181 |
| 3,524,905 | 8/1970 | Coates | 428/458 |
| 3,542,712 | 11/1970 | Gorton et al. | 428/357 |
| 3,547,682 | 12/1970 | Erb | 264/171 |
| 3,589,956 | 6/1971 | Kranz et al. | 156/62.4 |
| 3,595,731 | 7/1971 | Davies et al. | 428/296 |
| 3,639,195 | 2/1972 | Sanders | 428/296 |
| 3,644,254 | 2/1972 | Dew | 428/296 |
| 3,663,663 | 5/1972 | McAda | 428/296 |
| 3,739,956 | 6/1973 | Williamson | 428/394 |
| 3,801,428 | 4/1974 | Striegler et al. | 428/359 X |
| 3,803,453 | 4/1974 | Hull | 428/375 |
| 4,234,655 | 11/1980 | Kunimun et al. | 428/374 |

FOREIGN PATENT DOCUMENTS

| | | |
|---|---|---|
| 42-21318 | 10/1967 | Japan . |
| 44-22547 | 9/1969 | Japan . |
| 45-2345 | 1/1970 | Japan . |
| 52-12830 | 4/1977 | Japan . |
| 1149270 | 4/1969 | United Kingdom . |
| 1446570 | 8/1976 | United Kingdom . |

*Primary Examiner*—Lorraine T. Kendell
*Attorney, Agent, or Firm*—Fred Philpitt

[57] ABSTRACT

The heat-adhesive fine composite fibers of the present invention have a denier within the range of 1–20, and consist of as a first component, a crystalline polypropylene and as a second component, an ethylene-vinyl acetate copolymer, a saponification product thereof or a mixture of any of these materials with polyethylene, the content in said second component, of vinyl alcohol and/or vinyl acetate units based upon the total of vinyl acetate, vinyl alcohol and ethylene units being 0.5–18 mol %, and said second component forming at least one part of the fiber surface of said fibers. These fine composite fibers are superior in low temperature heat-adhesiveness, in adhesiveness with foreign raw materials, and in low crimpability. Further the fine composite fibers in which the second component has a specific density of 0.93 or less show almost no crimpability and are useful for wet-type non-woven fabrics. When a polypropylene having a Q value of 3.5 or less is used as the first component, the composite fiber can be obtained by spinning process alone with sufficient fiber strength, and the composite fibers having almost no sensible and latent crimping are very suitable for wet type non-woven fabrics.

7 Claims, No Drawings

HEAT-ADHESIVE COMPOSITE FIBERS

CROSS REFERENCE TO RELATED APPLICATIONS

This application is a continuation-in-part of application Ser. No. 062,814, filed Aug. 1, 1979, now U.S. Pat. No. 4,234,655; which in turn is a continuation-in-part of Ser. No. 031,989, filed Apr. 20, 1979, now abandoned; which in turn is a continuation of Ser. No. 842,660 filed Oct. 11, 1977, now abandoned.

DETAILED DESCRIPTION OF THE INVENTION

The present invention relates to heat-adhesive fine composite fibers and methods of production thereof.

More particularly it relates to fine composite fibers of crystalline polypropylene type having good low-temperature adhesiveness and good adhesiveness to foreign materials, and further heat adhesive fine composite fibers having substantially no curliness and suitable for wet-type non-woven fabrics (the terms wet type non-woven fabric described herein include paper), as well as production methods of these fibers.

Composite fibers obtained by subjecting two different polymers having different melting points and the production of non-woven fabrics by using these composite fibers have been disclosed in Japanese Patent Publication No. Sho 44-22547 (corresponding to U.S. Pat. No. 3,589,956), Japanese Patent Publication No. Sho 45-2345 (corresponding to British Pat. No. 1,149,270), and Japanese Laid Open Application No. Sho 49-75868 (corresponding to British Pat. No. 1,446,570).

Namely, non-woven fabrics may be formed by shaping composite fibers of the above mentioned structure usually in the form of web or the like, followed by heating them above the melting point of the lower melting component and below the melting point of higher melting component causing melt adhesion between contacting parts of the fibers.

However, heretofore produced heat adhesive composite fibers described above, having usually high adhesion temperature, need to be heated to a high temperature. And even when composite fibers employing polyethylene as a lower melting component is used, the heating temperature is not sufficiently low. Further, the prior art heat adhesive fibers have a drawback of poor adhesiveness of foreign materials such as cloth, wood, metal, etc. Consequently, when, for example, the foregoing non-woven fabrics are put to use by adhering them to other foreign materials or combined with other materials to form a composite material, the use of an additional binder is necessitated. And even when such a binder is used, the adhesiveness is not necessarily satisfactory. Moreover, since the prior art heat adhesive composite fibers generally had curliness to some extent, e.g. several or more crimps per 25 mm, they were inadequate as a material for the production of characteristic wet type non-woven fabrics such as paper which utilizes heat adhesiveness.

U.S. Pat. No. 3,739,567 discloses a heat adhesive yarn consisting of polypropylene-based yarn coated with ethylene-vinyl acetate copolymer and wax. However, the based yarn has a very large thickness in the range of 1,000 to 2,500 denier. Further the coating amount of ethylene-vinyl acetate copolymer is extremely large, i.e. it is preferably in the range of 250 to 750% by weight based upon the weight of the uncoated polypropylene yarn. Namely this coated yarn is very thick and the coating amount of the hot-melt copolymer is very large. In case of such a heat adhesive yarn, a fiber assembly e.g. a fiber assembly in the form of sheet hardly shows porous structure when it is subjected to heat treatment, because a large amount of hot-melt copolymer is brought to fused state and almost fills up the inter-fiber gaps. Further, because of its thickness it cannot give solft feeling. Further, according to a coating process, it is difficult to obtain a composite fiber having a fine denier, a thin adhesive layer and a uniform thickness.

An object of the present invention is to provide heat adhesive fine composite fibers of polypropylene which, without the above mentioned drawback of the prior art, have not only good low-temperature heat adhesiveness, but also good heat adhesiveness to foreign materials, and further heat adhesive composite fibers especially suitable for wet type non-woven fabrics, for porous shaped fibrous articles, and for soft-feeling non-woven fabrics, having good low-temperature heat adhesiveness as well as good adhesiveness to foreign materials, and having substantially no curliness.

For attaining the above-mentioned object, heat adhesive composite fibers of the present invention have a denier within the range of 1–20, and comprise a first component of crystalline polypropylene and a second component of an ethylene-vinyl acetate copolymer in which vinyl acetate content is 0.5–18 mol %, preferably 1–15 mol %, based upon the total amount of vinyl acetate and ethylene monomers, or a saponification product thereof, or a polymer mixture of any of said copolymer and/or saponification product with polyethylene which contains 0.5–18 mol % in total, preferably 1–15 mol % in total, of vinyl acetate and/or vinyl alcohol component (hereinafter these components will be referred to as vinyl monomer component) included in each polymer, based upon the total amount of vinyl monomer component and ethylene component in the whole mixture, and said heat adhesive composite fibers of the present invention are characterized in that said first component and second component are arranged in side-by-side or sheath and core composite relationship in which said second component forms a part of the surface of fibers.

The crystalline polypropylene used as the first component may be those usually employed for fibers or it may be those having a Q value of 3.5 or lower (explanation of Q will be made hereinafter). In either case, melt flow rate (according to ASTM D-1238(L), hereinafter it may be abbreviated to MFR) is 1–50, preferably 4–20.

As an ethylene-vinyl acetate copolymer used as the second component, those having a vinyl acetate content of about 5–40% by weight may be used. If the content of vinyl acetate is too high, the melting point of the copolymer becomes too low and the stickiness appears, and cannot be used for material which forms the surface of fiber. Moreover, poor stability to heat makes it inadequate for melt-spinning, particularly in case of fibers of fine denier such as 1–20d. This is also true for saponification products. Those having a vinyl acetate content of about 5% by weight or lower are not usually produced as multipurpose materials because they show less characteristics of ethylene-vinyl acetate copolymer. If those having a vinyl acetate content of about 5% by weight or lower can be used as a raw material, the effectiveness of the present invention can be obtained so long as the concentration of vinyl monomer in the second component is 0.5% or higher.

Ethylene-vinyl acetate copolymers having a considerably wide range of molecular weight may be used. However it would be better to avoid a melt index [according to ASTM D-1238(E) (hereinafter abbreviated to MI)] range of lower than 1 or higher than MI 50 because the former causes poor blendability and the latter is liable to create material like gum in the corner of eye (deposit of degradated resin) or to cause decomposition during the process of melt-spinning.

The above mentioned ethylene-vinyl acetate copolymer (hereinafter it may be abbreviated to EVA) of the present invention may be used without being saponified, or saponification products thereof (hereinafter it may be abbreviated to saponified EVA) may also be used. The degree of saponification may be optionally selected up to 100%.

When non-saponified EVA or saponified EVA of which the degree of saponification is lower than 30% is used in the second component, the second component is preferably prepared by mixing it with polyethylene so as to give a polyethylene content of 30% by weight or higher on the basis of the amount of the mixture because the use of unsaponified EVA or EVA of saponification degree lower than 30% alone is liable to cause inter-filamentary melt adhesion during the time of stretching of unstretched composite fibers. In case of those having a saponification value of 30% or more, the mixing with polyethylene is not necessary because inter-filament adhesion hardly occurs. Since the greater the saponification degree the greater the adhesive power of the saponified EVA to foreign material, it is rather preferable to use the saponified EVA in the above-mentioned range alone as the second component. However a mixture with polyethylene may also be used whereby the control of desirable melting point or density of the second component, handle or the like as a fiber product can be attained.

Polyethylene used in the present invention can be either of low, medium or high density. Low and medium density polyethylenes are preferable because they give weak latent heat crimpability to the resulting composite fibers and are advantageous in various heat treatments such as processing of non-woven fabrics. High density polyethylene may be employed in case where somewhat strong latent crimpability is permissible or preferable.

Mixing of EVA or saponified EVA and polyethylene is done so as to give the total amount of vinyl monomer component in the polymer mixture of 0.5 mol % or higher, preferably 1–15 mol %, based upon the total amount of the monomers of vinyl monomer component and ethylene component therein. The relationship of weight percent and mol percent of vinyl acetate component in EVA is as follows: For example 5% by weight corresponds to about 1.7 mol % and 40% by weight corresponds to about 18 mol %. Thus the content of vinyl acetate component in a polymer mixture consisting of 30% by weight of EVA containing 5% by weight of vinyl acetate and 70% by weight of polyethylene is 0.5 mol %. In the above-mentioned case wherein 30% by weight of a 100% saponified EVA is used, the content of vinyl alcohol component becomes 0.5 mol % i.e. almost same as in the above-mentioned case. To attain 0.5 mol % vinyl monomer content in the polymer mixture, an EVA containing 40% by weight of vinyl acetate component or a 100% saponified EVA thereof is mixed with polyethylene in a ratio of 3.8% by weight in the case of the former and 3% by weight in the case of the latter. For the use of EVA and saponified EVA, these ratios are minimum miscible values, respectively.

When the content of vinyl monomer component is smaller than 0.5 mol %, the adhesive strength of fiber is insufficient. Up to 18 mol %, the larger the content of the vinyl component, the greater the adhesive strength of the fiber without bringing about such drawbacks as excessive reduction of the melting point or troubles associated with adhesiveness. A vinyl monomer content of 1–15 mol % is still more preferred in view of adhesive power as well as easiness of handling and spinnability.

The second component having a MI of 1–50, preferably 10–30, is preferable even when polyethylene is mixed as in the case where the copolymer is present in 100%, in view of the spinnability of the composite fibers.

When the density of the second component of the composite fibers is made 0.93 or lower by the formulation as described above, the resultant composite fibers show low crimpability irrespective of whether it is visible or latent crimp, provide products of superior dimentional stability when they are made into non-woven fabrics and thus especially advantageous in preparing wet-type non-woven fabrics.

The specific gravity of ethylene-vinyl acetate copolymer increases with the increase of vinyl acetate content, e.g. if vinyl acetate content increases from 10%, to 20%, 30%, and 40% by weight, respectively, the specific gravity increases from 0.93 to 0.94, 0.96 and 0.97, respectively though the relation shows a certain extent of variation depending upon production process. The same relation exists in case of saponified products. Thus second components of various densities can be obtained by selecting the kind and mixing ratio of vinyl comonomer and ethylene.

For attaining the melt-adhesion of the low melting component while keeping the shape of fiber during the time of heating heat adhesive composite fibers as those of the present invention, it is preferable that they consist of two components usually having a large difference in melting points. In the case of the present composite fiber, the melting point of the first component crystalline polypropylene (high melting component) is about 165° C. On the other hand, the lowest melting point of the second component polymer is about 50° C. in the case of vinyl acetate containing 40% by weight of EVA and even the highest melting point is about 130° C. which is in the neighborhood of 135° C. for high density polyethylene. Thus the difference of the melting points of the two components is great enough, and various kinds of polymers can be adequately selected and combined within the above-mentioned range to provide composite fibers having adequate melting point of the second component as well as desirable handle.

On account of adhesiveness of the second component, it must naturally form a part of the surface of fibers. By reason of melt-spining technique, this surface formation is usually accomplished continuously in the longitudinal direction of the fibers. And this is preferable to intermittent formation in view of the efficacy of adhesion, although the latter still possesses some adhesive effect. Although adhesiveness is given to some extent even when the ratio of the second component occupying the fiber surface is 20–30% or so in terms of circumferential ratio of fiber cross-section, a ratio of 50% or greater is preferable giving sufficient adhesive effect. When the cross-sectional circumferential ratio is 85% or larger, adhesive effect is especially fine. Accordingly if a strong adhesiveness is required, the ratios in that range including 100% (including the case of sheath and core type) are preferably employed, although a certain extent of difficulty in handling may occur in case where the amount of ethylene-vinyl acetate in EVA is so large as being close to the upper limit of the present invention. On the other hand, if a heat-adhesive composite fiber having well-balanced properties in adhesiveness and handling is required, a side-by-side type fiber having a circumferential ratio of fiber cross-section of the second component in the range of 50–85% is preferably employed and easy to produce.

The composite ratio of the first component to the second component is preferably 40:60 to 70:30. If the composite ratio of the second component exceeds 60, winding of yarn becomes difficult because of the reduced spinnability, and if it becomes lower than 30%, adhesive strength by heat adhesion is weakened due to too small thickness of the second component even when its cross-sectional circumferential ratio of the fiber is within the preferable range.

When the melt flow rate of the second component after spinning is 1.5 to 6 times as large as that of the first component, the number of crimps after stretching is smaller irrespective of whether it is side-by-side or sheath and core type composite fiber. In many cases it is about 12 waves/25 mm or smaller and latent crimpability is scarcely present.

Since the heat adhesive composite fibers of the present invention have good heat adhesiveness not only between contacting fibers but also between fibers and foreign materials such as cloth, wood, metal etc., they may be, for example, cut into an appropriate length of staples to form web and made into non-woven fabrics by heating in order to accomplish heat-adhesion to a foreign material. Alternatively formation of a non-woven fabric and adhesion to a foreign material can also be done simultaneously by contacting web, as it is, with a foreign material followed by heating. Heating is done at a temperature higher than the melting point of the second component and lower than that of the first component. This is usually attained at the above-mentioned temperature by press-contacting for one to several minutes. Composite sheets produced in the above mentioned manner, for instance, by heat-pressing the web composed of the composite fibers of the present invention to paper, show excellent peeling strength enabling us to omit or simplify the binder application step which has been heretofore required in production. Further, since the composite fibers of the present invention have usually smaller latent crimpability, dimentional stability of non-woven fabrics is secured owing to small shrinkage when it is formed by heating and press-adhesion.

The composite fibers of the present invention show smaller crimpability with the reduction of the density of the second component, and are suitable also for wet-type non-woven fabrics. Especially, those in which the second component has a density of 0.93 or lower and unstretched yarns produced by high draft spinning using, as a first component, crystalline polypropylene having a Q value of 3.5 or smaller (explanation will be given below) have almost no visible crimp and no latent crimpability and are very excellent to be used for wet-type non-woven fabrics. For example, the above mentioned composite fibers of the present invention composed of a small denier filament, preferably 1–4 d, are cut into approximately 5 mm size and made into paper. In this case paper making can be done either by mixing the composite staple fibers with other raw materials such as rayon, pulp, etc. or by using the fibers of the present invention singly as a raw material. In these ways, the structure is stabilized by heat-adhesion between fibers and paper having a large wet strength and good low temperature heat sealability can be obtained.

Further, since the composite fibers of the present invention can have a controlled heat adhesion temperature in a wide range of from about 50° to about 130° C., a heat adhesion temperature and a drying temperature in a dryer after paper making can be selected so that melt-adhesion of the second component can partly occur during the time of drying. Thus paper having good strength as well as good wet strength can be obtained. In the case of common polypropylene fibers, additional heat treatment at a high temperature is often carried out after paper making to give better paper strength. Whereas in the case of the composite fibers of the present invention, such a step may be omitted. Moreover, since the polypropylene component does not melt but maintains the fiber shape even after drying and heat-adhesion, resultant paper shows not only good handle but also an excellent heat-sealability. Especially, paper which uses a composite fiber of the present invention having somewhat low heat adhesion temperature has an outstanding heat-sealability.

Next, explanation will be given about two processes for producing the heat-adhesive fine composite fibers of the present invention as described above.

Firstly, the first process comprises a melt-spinning step and a stretching step as illustrated below. Namely, it is characterized in that by using, as a first component, crystalline polypropylene and as a second component the ethylene-vinyl acetate copolymer in which the content of vinyl acetate component is 0.5–18 mol %, preferably 1–15 mol % based upon the total monomer amount of the vinyl acetate component and the ethylene component, or a saponification product thereof, or a polymer mixture of said copolymer or said saponification product and polyethylene, containing 0.5–18 mol %, preferably 1–15 mol %, of vinyl monomer component based upon the total monomer amount of vinyl monomer component and ethylene component in said whole mixture, side-by-side type or sheath and core type fine composite fibers are formed by melt-spinning in such a way that the second component occupies a part of the surface of fiber, and resultant unstretched composite fibers are subjected to stretching at 25° C. to a temperature lower than the melting point of the second component by 10° C., and to 3–6 times the original length.

Crystalline polypropylene, ethylene-vinyl acetate copolymer and polyethylene used as the raw materials are as explained above. The draft employed in the melt-spinning of this production process is to the extent usually taken for the production of polypropylene fibers which is less than 300 and about 200 in most standard case. The raw material polypropylene used in the melt spinning with such an extent of spinning draft is the kind commonly used for fibers purpose having a Q value (explained below) of 4–7 or so. However, those having a Q value of 3.5 or smaller may also be employed.

The apparatus for producing side-by-side or sheath and core type composite fibers may be commonly used one. When the two components are spun by using a side-by-side type melt-spinning apparatus, the fiber cross-sectional circumferential ratio of the second component is mainly controlled by the ratio of the melt flow rate of the second component relative to the first component (hereinafter this may be abbreviated to melt flow rate ratio) after spinning, so long as the composite ratio of the two components does not go to extremes and falls in the above mentioned composite ratio range. When the melt flow rate ratio is 1, the fiber cross-sectional circumferential ratios of the two components are approximately same. As the melt flow rate ratio becomes greater than 1, the fiber cross-sectional circumferential ratio of the second component also become greater, that is, when the melt flow rate ratio is 1.5, 5 or 6, the circumferential ratio becomes about 60%, about 85% or 90% or more, respectively. Further, when the melt flow rate ratio is 1.5–6, both side-by-side and sheath and core type composite fibers show only a small number of crimps after stretching, usually several crimps or less per 25 mm.

Accordingly, for the requirements that number of crimps should be fewer, an adequate adhesiveness should be possessed and handling should be easier, a side-by-side type having a melt flow rate ratio of 1.5–5 is most preferable. Especially when the density of the second component is 0.93 or smaller as described above, crimpability is scarcely present. Sheath and core type structure can be readily obtained by using a spinning apparatus for that purpose.

The temperature of melt-spinning is in the range of 200°–350° C., preferably 230°–300° C., for the first component and 180°–280° C., preferably 200°–250° C. for the second component.

The obtained unstretched fibers are subjected to stretching to 3–6 times at 25° C. at a temperature lower than the melting point of the second component by 10° C. Somewhat higher stretching temperatures provide fibers of little latent crimpability, and percent shrinkage per unit area at the time of non-woven fabric formation is smaller when web formed therefrom is heated. When the stretching temperature is lower, heat shrinkage proves to be greater because of the insufficiency of stress relaxation at the time of stretching. The appropriate temperature varies according to the vinyl monomer content in the second component. Temperatures higher than that lower than the melting point of the second component by 10° C. are not adequate because molten fibers adhere to a stretching apparatus.

The second process for the production is quite unique and comprises only melt-spinning step.

Usually, fibers for wet-type non-woven fabrics, especially for paper making, having a denier of as small as 4 or smaller are preferably used. With fibers having such a small denier, there is a limitation in spinning draft in the production of polypropylene fiber because of spinnability of commonly available polypropylene. Thus such fibers cannot be produced by spinning-take-up step alone and they are produced by two step drafts applied in both spinning and stretching (usually 2–6 times stretching) in order to attain a desired denier. When a composite structure is taken in order to reduce melt-adhesion temperature and fibers contain as a major part of one composite component, an ethylene-vinyl acetate copolymer or the like which has by itself poor spinnability, the spinnability is greatly reduced. Thus the necessity of stretching step becomes much greater for the production of small denier fibers having the above-mentioned structure.

Surprisingly, however, denier of 4 or smaller can be attained with spinning-take up step alone even from composite fibers containing a component of poor spinnability as mentioned above by using, as polypropylene component, the polymers having a narrower molecular weight distribution obtained by decomposing crystalline polypropylene polymerized with a usual Ziegler-Natta catalyst by an appropriate method as described below instead of said crystalline polypropylene. In this manner, low melting heat-adhesive polypropylene composite fibers having substantially no crimpability could be obtained without conducting stretching which is usually carried out after spinning. And what is still better this process has many advantages as hereinafter explained.

This process is characterized in that the first component comprising crystalline polypropylene having a Q value of 3.5 or smaller (hereinafter this may be abbreviated to low Q value polypropylene) and the second component comprising the ethylene-vinyl acetate copolymer having a vinyl acetate content of 0.5–18 mol %, preferably 1–15 mol %, based upon the total monomer amount of both vinyl acetate component and ethylene component, or a saponification product thereof, or a polymer mixture of said copolymer or said saponification product and polyethylene, having a vinyl monomer content of 0.5 mol % or higher, preferably 1–15 mol % based upon the total amount of the component monomers in the polymer mixture are arranged in a side-by-side or a sheath and core type relationship, subjected to melt-spinning so as to make the second component occupy a part of fiber surface, and wound up in a spinning draft ratio of 600–3000.

It is necessary that the first component of a low Q value polypropylene has a Q value of 3.5 or smaller. Thus copolymers with an α-olefin such as a small amount of ethylene or butene-1 may be used. The Q value herein described refers to MW/MN (MW indicates weight-average molecular weight and MN indicates number-average molecular weight) and is usually used to show the state of molecular weight distribution. There is no change of Q value by melt-spinning or very small even if there is any and the Q values before and after spinning may be considered same. The molecular weight distribution of the so called isotactic polypropylene produced by polymerization carried out with a common Zeigler-Natta type catalyst, a combination of a transition metal compound and an alkyl aluminum compound, has a Q value of 4–7 and hence it cannot be used as it is for the present invention. The raw material of low Q value polypropylene of the present invention may be obtained by a known method. For example, polypropylene produced according to the above mentioned method is subjected to heat-melting after the addition of an organic-peroxide such as dicumylperoxide, a phosphorus compound such as trilauryl trithiophosphite and oxygen, etc., or to decomposition by intense shear. Although spinnability improves as the molecular weight distribution becomes narrower (namely Q value becomes smaller), it is amazing that if those having a Q value of 3.5 or smaller are used, spinning is still possible with several thousands more intense draft even when a fiber has a composite structure and contains as one component, an ethylene-vinyl acetate copolymer or a saponification product thereof having poor spinnability. This fact has been found by the inventors of the present invention. As a result, it has become possible to manufacture heat adhesive composite fibers of the present invention having a denier of as small as approximately 1–20 denier by composite spinning of crystalline polypropylene and an ethylene-vinyl acetate or the like. Moreover the obtained composite fibers are still in an unstretched state, substantially free of crimp and also free of latent crimpability. Accordingly, they are used preferably for wet-type non-woven fabrics.

A Q value of polypropylene of 3.5 or smaller gives a sufficient effectiveness of the present invention and smaller Q value is still preferable. In the examples of the present invention those having a Q value of up to as small as 2 are illustrated but those having a Q value of smaller than 2 may be used.

In this production process, other conditions, namely, characteristics of each raw material such as physical properties of the first component crystalline polypropylene other than Q value, for example melt flow rate etc., the available range of contents, the preferable range of contents or physical properties of the second component of ethylene-vinyl acetate copolymer, the saponification product thereof, ethylene, and the second component as a whole, and further the spinning apparatus, such conditions as temperature, composite ratio, etc., other than draft at the time of melt-spinning, the relationship of the spinning apparatus, the MFR ratio of the first and the second component, and the cross-sectional circumferential ratio, and the like were same as in the case of said first production process.

The strengths of the composite fibers produced by this production process were somewhat smaller because they have not been stretched after spinning, and yarn tenacity showed 0.6–3 g/d. When they were used for non-woven fabrics, for example, paper, the controlling factors of paper strength are water dispersibility and adhesive strength at the time of paper making rather than tenacity of yarn. Therefore, when the composite fibers obtained by this production process were used, reduction of the strength is not observed at all even when the yarn tenacity is in the above-mentioned order.

Next, explanation of advantages of this second process for producing composite fibers will be given. The most fundamental feature of this production process is the absence of stretching and the advantages mainly are derived from that point. Namely, the absence of stretching step saves the costs of equipments as well as personnels and improves the requirement of raw materials. Further, in a process including a stretching step, selection of polyethylene to be mixed with EVA, etc. becomes necessary in order to avoid inter-filamentary melt-adhesion which tends to occur at the time of stretching when vinyl acetate in the second component exceeds a certain extent. In the case of the present invention, however, the absence of the stretching step eliminates apprehension about the troubles liable to occur at the time of stretching, and enlarges a possible range of selection of polyethylene, enables us to use in the combination, such a kind of polyethylene as those liable to cause peeling of the composite components at the time of stretching. Moreover, it is a usual practice of stretching for better production efficiency to carry out stretching after combining tows obtained by spinning to about 400,000–700,000 denier, but it is necessary to divide tows again into those having a desired denier after stretching depending upon the usage, if the use in the form of tow is desired. Such dividing of tows is very troublesome. In the case of the process of the present invention, tows having a desired denier can be easily obtained by combining a necessary amount of tows of minimum unit of each spindle after spinning.

Hereinafter examples, comparative examples, and an example of paper making will be given. The definitions of terms and methods of measuring physical properties used therein are explained as follows.

Percent shrinkage of non-woven fabric

Staple fibers having a 64 mm fiber length are subjected to carding to form 200 g/m$^2$ webs. Thereafter pieces of webs having a size of 25 cm×25 cm are subjected to heat treatment for 5 minutes at a predetermined temperature using a hot wind dryer, and the longitudinal length (a cm) and the lateral length (b cm) of said piece are measured after the heat-treatment. The percent shrinkages per unit area are calculated according to the following equation. By this specific value, the extent of development of crimps at the time of the heat treatment can be known.

$$\text{Percent shrinkage (\%)} = (1-(a\times b)/(25\times 25))\times 100$$

Tensile strengths of non-woven fabric

Non-woven fabrics prepared according to above-mentioned manner are cut to rectangular pieces of 5 cm width and 20 cm length and tensile strengths are measured at a test length of 10 cm and a constant velocity of 100 mm/minute using an Instron Tensile Testing Machine.

Strengths and elongations of filaments

Using an Instron Tensile Testing Machine, measurements are carried out at a test length of 20 cm and a velocity of 20 mm/minute.

Breaking length

The measurements are conducted according to JIS P 8113. In the case of wet sample, measurements are conducted after dipping fibers in water at 20° C. for 10 minutes.

$$\text{Breaking length (km)} = (\text{Tensile strength (kg)}/(B\times W))\times 1000$$

B: width of text piece (mm)
W: basis weight of test piece (g/m$^2$)

Peeling strengths of adhesion to foreign material

Pieces having a size of 20 mm width×100 cm length adhered to foreign materials are measured by using an Instron Tensile Test Machine at a tensile velocity of 50 mm/minute.

Peeling strengths of paper

Paper samples having a size of 15 mm width×200 mm length are folded to the half a size of 15 mm width and 100 mm length and subjected to heat-sealing with a heat sealer adjusted to a predetermined temperature at a pressure of 2.8 kg/cm$^2$ for a certain period of time. A small part of the adhered surfaces from one end thereof is peeled and the peeling strength is measured by using an Instron Testing Machine at a test length of 50 mm and a tensile velocity of 50 mm/minute.

Tensile strengths of Paper

Paper samples having 15 mm width×200 mm length are measured by using an Instron Testing Machine at a test length of 150 mm and a tensile velocity of 50 mm/minute.

Density of polyethylene

When the density of polyethylene is indicated not with numerical values but by "low", "medium" and "high", they have following values according to the classification.

low density: lower than 0.93
medium density: 0.93–0.95
high density: higher than 0.95

EXAMPLES 1–11

By using, as a first component, crystalline polypropylene (MFR is 4–5 g per 10 minutes) and as a second component, mixture of various kinds of ethylene-vinyl acetate copolymer and polyethylene having various mixing ratios or a saponification product (saponification degree of 80%) of ethylene-vinyl acetate copolymer (having 12.2 mol % of vinyl acetate) (only example 10) and by arranging these two components with predetermined composite ratios in side-by-side or sheath and core relationship, composite fibers were prepared. The spinnability of melt-spinning was excellent without leaving no problem at all in all cases. The spinning and stretching conditions for these composite fibers were as follows.

| | | |
|---|---|---|
| Spinning condition; spinning jet, 1.5 mmϕ × 60 holes Except the jet for the sheath and core type composite fibers used in Example 5, all other jets were for side-by-side type composite fibers. | | |
| Temperature; | Second component (PE, EVA) side | 200° C. |
| | First component (PP) side | 300° C. |
| Delivery amount; | 72 × 2 g/min. | |
| Winding velocity; | 300 m/min. | |
| Stretching ratio; | 4 times (ultimate stretched denier was 18d) | |

Results are shown in Table 1. In the table marks o in the stretchability show good cases and marks Δ show cases in which slight tendency of melt-adhesion was observed.

TABLE 1

| No. | Composite ratio 1st component / 2nd component | Second composite component: Ethylene vinyl acetate copolymer (EVA) Vinyl acetate content wt %/mol % | MI | Polyethylene (PE) Density | MI | Mixing ratio EVA/PE | Vinyl monomer in the 2nd component (mol %) |
|---|---|---|---|---|---|---|---|
| Ex. 1 | 50/50 | 28/11.3 | 15 | 0.960 | 25 | 50/50 | 5.63 |
| Ex. 2 | 50/50 | 28/11.3 | 15 | — | — | 100/0 | 11.3 |
| Ex. 3 | 50/50 | 28/11.3 | 15 | 0.916 | 23 | 30/70 | 3.38 |
| Ex. 4 | 50/50 | 19/7.11 | 15 | — | — | 100/0 | 7.11 |
| Ex. 5 | 40/60 | 19/7.11 | 15 | 0.916 | 23 | 50/50 | 3.56 |
| Ex. 6 | 50/50 | 14/5.04 | — | — | 100/0 | 5.04 | |
| Ex. 7 | 50/50 | 14/5.04 | 15 | 0.916 | 23 | 50/50 | 2.52 |
| Ex. 8 | 50/50 | 19/7.11 | 15 | 0.926 | 20 | 50/50 | 3.56 |
| Ex. 9 | 60/40 | 19/7.11 | 15 | 0.916 | 23 | 50/50 | 3.56 |
| Ex. 10 | 50/50 | 30/12.2* (saponification degree 80%) | 17 | — | — | 100/0 | 12.2 |
| Ex. 11 | 50/50 | 32 | 30 | 0.944 | 35 | 30/70 | 3.99 |

| No. | Spinning MFR and ratio of 2nd component/1st component (value of ratio) | Cross-sectional circumference ratio of the 2nd component (%) | Stretchability (stretching temperature) | percent shrinkage of non-woven fabrics (heating temperature) |
|---|---|---|---|---|
| Ex. 1 | 34.7/9.61 (3.6) | 76 | (80° C.) | 41% (145° C.) |
| Ex. 2 | 53.2/9.61 (5.5) | 88 | Δ (25° C.) | — |
| Ex. 3 | 31.0/9.67 (3.2) | 75 | (100° C.) | 4% (130° C.) |
| EX. 4 | 32.3/9.9 (3.3) | 75 | (60° C.)<br>Δ (80° C.) | 49% (130° C.)<br>— |
| Ex. 5 | 42.7/9.9 (4.3) | 100 | (80° C.) | 0–1.5% (145° C.) |
| Ex. 6 | 32.3/9.9 (3.3) | 76 | (60° C.)<br>Δ (80° C.) | 64% (130° C.)<br>— |
| Ex. 7 | 41.6/9.9 (4.2) | 81 | (80° C.) | 1.5% (130° C.)<br>5% (145° C.) |
| Ex. 8 | 39.5/9.54 (401) | 80 | (100° C.) | 5% (145° C.) |
| Ex. 9 | 48.0/0.54 (5.0) | 84 | (80° C.)<br>(100° C.) | 6% (145° C.)<br>2.3% (145° C.) |
| Ex. 10 | 51.2/9.54 (5.4) | 86 | (100° C.) | 2.5% (145° C.)<br>4% (120° C.) |
| Ex. 11 | 55.3/9.54 (5.8) | 91 | (100° C.) | 2.5% (125° C.) |

*The value of vinyl acetate content is that before saponification. Those which have been saponified to 80% saponification degree were used.

The staples of composite fibers in each of the above-mentioned examples were fed into a carding machine to form webs having 200 g/m$^2$. Resultant webs were put on such a foreign material as a cotton cloth, a tin-plate sheet or a paper and pressed at a temperature of 130° C. under a pressure of 0.5 Kg/cm$^2$ G for one minute to effect adhesion whereby the formation of good layers of non-woven fabrics, the adhesion of said layers to the above-mentioned foreign materials could be attained, resulting in various composite materials. With regard to some of these examples, peeling strengths were measured. The results are shown in Table 2. The examples selected here show particularly small percent shrinkage of non-woven fabrics and especially superior in the utilization.

TABLE 2

| Composite fibers used | Peeling strength (g/2cm) to cotton cloth | to tin-plate sheet | to paper*2 |
|---|---|---|---|
| Example 6 | 920 | 30 | 200 |
| Example 9 | 790 | 20 | 160 |
| Example 10 | 1590 | 530 | 700 |
| Example 11 | 650 | 20 | 130 |
| PP-PE composite fibers (for comparison)*1 | 150 | 0 | 50 |

*1Composite fibers obtained by the same procedure as in Example 6 except all the second components was polyethylene.
*2Kraft paper

EXAMPLES 12–20, COMPARATIVE EXAMPLE 1

By using as a first component, crystalline polypropylene, and as a second component, mixtures of various kinds of ethylene-vinyl acetate copolymers and polyethylene, side-by-side type or sheath and core type composite fibers having the above-mentioned two components arranged with predetermined composite ratio could be prepared. The spinnability and stretchability of melt spinning process were excellent in all cases. The spinning and stretching condition of these composite fibers were as follows.

Spinning jet: 0.6 mmϕ×240 holes

Except the jet used in Example 15 for the spinning apparatus of sheath and core type composite fiber, a side-by-side type composite spinning apparatus is used for all examples.

| | | |
|---|---|---|
| Temperature: | 1st component side | 300° C. |
| | 2nd component side | 230° C. |

Each of raw material resins is shown in Table 3 and composite ratio, stretching condition and properties of resultant filaments are shown in Table 4.

TABLE 3

(Raw material, resin)

| No. | Second Component: Ethylene vinyl acetate copolymer (EVA) Vinyl acetate content (% by weight)/mol % | MI | Polyethylene (PE) Kind | MI | Density (g/cc) | Mixing ratio (EVA/PE) | Vinyl monomer in the second component (mol %) | First component (PP) MFR |
|---|---|---|---|---|---|---|---|---|
| Example 12 | 20/7.53 | 20 | low density | 23 | 0.916 | 10/90 | 0.753 | 3.7 |
| Example 13 | 33/13.8 | 30 | " | 20 | 0.915 | 28/72 | 3.86 | 4.6 |
| Example 14 | 15/5.43 | 12 | " | 35 | 0.918 | 28/72 | 1.52 | 4.6 |
| Example 15 | 19/7.10 | 15 | " | 8 | 0.919 | 10/90 | 0.71 | 4.6 |
| Example 16 | 20/7.53 | 20 | medium density | 15 | 0.944 | 15/85 | 1.13 | 3.7 |
| Example 17 | 32/13.3 | 30 | low density | 20 | 0.915 | 20/80 | 2.66 | 6.9 |
| Example 18 | 32.5/13.6* (saponification degree 40%) | 20 | " | 35 | 0.918 | 25/75 | 3.40 | 6.9 |
| Example 19 | 15/5.43 | 12 | medium density | 15 | 0.944 | 50/50 | 2.72 | 4.6 |
| Example 20 | 15/5.43 | 12 | low density | 8 | 0.918 | 50/50 | 2.72 | 9.9 |
| Comparative Example 1 | — | — | high density (50 parts) | 35 | 0.960 | 0/100 | — | 6.9 |
| | | | low density (50 parts) | 23 | 0.916 | | | |

*The values of vinyl acetate content are those before saponification. Those shown in Table are saponified to 40% saponification degree in use.

TABLE 4

(Composite ratio, stretching condition and physical properties)

| | Composite ratio: 1st component / 2nd component | Stretching condition: Temperature °C. | Stretch ratio | Physical properties of fibers: Denier per filament | Number of crimps (waves/25 mm) | Percent cross-section circumference % (MFR of 2nd component / MFR of 1st component = ratio of melt flow rate) | Second component Density (g/cc) | Shrinkage of non-woven fabrics (heating temperature 145° C. %) |
|---|---|---|---|---|---|---|---|---|
| Ex.12 | 50/50 | 100 | 3.5 | 1.5 | 0 | $90\left(\frac{44.7}{7.8} = 5.73\right)$ | 0.919 | 3 |
| Ex.13 | 70/30 | 50 | 4.5 | 2 | 0 | $71\left(\frac{49.3}{9.8} = 5.03\right)$ | 0.928 | 2 |

TABLE 4-continued (Composite ratio, stretching condition and physical properties)

| | Composite ratio 1st component 2nd component | Stretching condition Temperature °C. | Stretch ratio | Physical properties of fibers: Denier per filament | Number of crimps (waves/25 mm) | Percent cross-section circumference % (MFR of 2nd component / MFR of 1st component = ratio of melt flow rate) | Second component Density (g/cc) | Shrinkage of non-woven fabrics (heating temperature 145° C. %) |
|---|---|---|---|---|---|---|---|---|
| Ex.14 | 50/50 | 80 | 4.5 | 3 | 0 | 84 (50.7/9.8 = 5.17) | 0.922 | 0 |
| Ex.15 | 50/50 | 90 | 4.5 | 3 | 1 | 100* (20.2/9.8 = 2.06) | 0.921 | 5 |
| Ex.16 | 50/50 | 100 | 5 | 3 | 3 | 80 (33.2/7.8 = 4.26) | 0.943 | 7 |
| Ex.17 | 50/50 | 70 | 5.5 | 4 | 0 | 73 (45.6/14.4 = 3.17) | 0.923 | 0 |
| Ex.18 | 40/60 | 90 | 5 | 3 | 0 | 79 (58.3/14.4 = 4.05) | 0.927 | 2 |
| Ex.19 | 50/50 | 100 | 4 | 3 | 8 | 63 (27.7/9.8 = 2.83) | 0.939 | 2 |
| Ex.20 | 50/50 | 100 | 4 | 3 | 12 | 55 (23.9/21.1 = 1.13) | 0.926 | 23 |
| Comparative ex. 1 | 50/50 | 100 | 4 | 3 | 0 | 70 | 0.938 | — |

*Sheath and Core structure

The case of the use of polyethylene alone as a second component (Comparative example 1), is illustrated together. The following use was made with these composite fibers.

(1) Example of paper making. The composite fibers of Examples 17 and 18 and Comparative example 1 were each cut into short length of 5 mm as raw materials for paper making. After blending of paper raw materials, paper making was carried out in accordance with the method of JIS P8209. Drying was carried out at a dryer temperature of 100° C. to produce sheets of synthetic fiber paper having a basis weight of about 30 g/m$^2$. Physical properties of resultant paper are shown in Table 5.

TABLE 5

(Paper-making test)

| Paper making example | Formulation of paper raw material (%): PP type fibers | | Rayon | NBKP | PVA | Characteristic physical properties of paper incorporated with PP: Tensile strength (kg/15 mm) dry | Tensile strength (kg/15 mm) wet | Breaking length (Km) dry | Breaking length (Km) wet | Peeling strength (g/15 mm) Heat seal condition 130° C. 0.5 sec. | Peeling strength (g/15 mm) Heat seal condition 170° C. 0.5 sec. |
|---|---|---|---|---|---|---|---|---|---|---|---|
| 1 | Example 17 | 30 | — | 70 | — | 1.86 | 0.301 | 4.13 | 0.665 | 110 | 180 |
| 2 | Example 18 | 30 | — | 70 | — | 1.95 | 0.337 | 4.41 | 0.748 | 140 | 200 |
| 3 | Comparative example 1 | 30 | — | 70 | — | 1.20 | 0.0482 | 2.64 | 0.111 | 0 | 26 |
| 4 | PP fiber (3d) | 30 | — | 70 | — | 0.871 | 0.0363 | 1.93 | 0.076 | 0 | 0 |
| 5 | Example 17 | 30 | 30 | 35 | 5 | 1.89 | 0.296 | 4.18 | 0.657 | 150 | 180 |
| 6 | Example 18 | 30 | 30 | 35 | 5 | 2.11 | 0.345 | 4.49 | 0.773 | 170 | 190 |
| 7 | Comparative example 1 | 30 | 30 | 35 | 5 | 1.23 | 0.0571 | 2.81 | 0.126 | 4 | 53 |
| 8 | PP fiber (3d) | 30 | 30 | 35 | 5 | 1.04 | 0.0436 | 2.33 | 0.094 | 0 | 0 |
| 9 | Example 17 | 50 | — | 50 | — | 1.79 | 0.286 | 3.96 | 0.634 | 180 | 210 |
| 10 | Example 18 | 50 | — | 50 | — | 1.84 | 0.320 | 4.09 | 0.707 | 220 | 240 |
| 11 | Comparative example 1 | 50 | — | 50 | — | 0.856 | 0.0374 | 1.90 | 0.083 | 0 | 94 |

TABLE 5-continued (Paper-making test)

| Paper making example | Formulation of paper raw material (%) | | | | Characteristic physical properties of paper incorporated with PP | | | | | |
|---|---|---|---|---|---|---|---|---|---|---|
| | | | | | Tensile strength (kg/15 mm) | | Breaking length (Km) | | Peeling strength (g/15 mm) Heat seal condition | |
| | PP type fibers | Rayon | NBKP | PVA | dry | wet | dry | wet | 130° C. 0.5 sec. | 170° C. 0.5 sec. |
| 12 | PP fiber (3d) 50 | — | 50 | — | 0.621 | 0.0163 | 1.37 | 0.035 | 0 | 0 |

(2) By using the fibers of each of the Examples and Comparative example, non-woven fabrics were prepared. The conditions were as explained in the above-mentioned definition of the percent shrinkage of non-woven fabrics and the results are shown in Table 4.

(3) The staples of composite fibers (18 d×64 mm) of each of the above-mentioned examples were subjected to a carding machine to form webs of 200 g/m$^2$. These webs were placed on foreign raw materials such as cotton fabrics, paper sheets, etc. and effected adhesion by pressing at a temperature of 130° C., under a pressure of 0.5 Kg/cm$^2$G for one minute. Each of them formed good layers of non-woven fabrics and could be adhered with these foreign materials, resulting in composite materials.

EXAMPLES 21–26

Production of polypropylene having a narrower molecular weight distribution.

To the polypropylene powder having a MFR of 0.76 and a Q value of 6.3, 0.015% by weight of 2,5-dimethyl-2,5-ditertiarybutylperoxyhexane was added and the mixture was pelletized at 280° C. with a 65 mmϕ extruder to obtain the polypropylene pellets having a MFR of 7.0 and a Q value of 2.6.

The combination conditions of resultant polypropylene pellets with various kinds of second components are varied in spinning whereby the results shown in Tables 6 and 7 are obtained (The Q-values of each examples in Table 6 are the Q-value of the first component after spinning).

TABLE 6

(Raw material resin)

| | Second component | | | | | | | | First component (pp) | |
|---|---|---|---|---|---|---|---|---|---|---|
| | Ethylene vinyl acetate copolymer (EVA) | | | Polyethylene (PE) | | | | | | |
| | Vinyl acetate content (% by weight)/(% by mol) | MI | Density (g/cc) | Kind | MI | Density (g/cc) | Mixing ratio (EVA/PE) | Vinyl monomer in the second component (mol %) | MFR | Q value |
| Ex. 21 | 20/7.53 | 20 | 0.941 | — | — | — | 100/0 | 7.53 | 7.0 | 2.6 |
| Ex. 22 | 20/7.53 | 20 | 0.941 | low density | 23 | 0.916 | 25/75 | 1.88 | 7.0 | 2.6 |
| Ex. 23 | 32/13.3 | 30 | 0.955 | high density | 25 | 0.960 | 10/90 | 1.33 | 7.0 | 2.6 |
| Ex. 24 | 30/12.2* (Saponification degree 80%) | 17 | 0.950 | — | — | — | 100/0 | 12.7 | 7.0 | 2.6 |
| Ex. 25 | 28/11.2 | 18 | 0.950 | low density | 23 | 0.916 | 50/50 | 5.60 | 7.0 | 2.6 |
| Ex. 26 | 14/5.03 | 15 | 0.930 | " | 23 | 0.924 | 50/50 | 2.52 | 7.0 | 2.6 |
| Comparative ex. 2 | 20/7.53 | 20 | 0.941 | " | 23 | 0.916 | 25/75 | 1.88 | 7.3 | 6.4 |
| Comparative ex. 3 | " | " | " | " | " | " | 50/50 | " | " | " |
| Ex. 27 | 20/7.53 | 20 | 0.941 | medium density | 35 | 0.944 | 50/50 | 3.77 | 21.0 | 2.2 |
| Ex. 28 | 19/7.10 | 15 | 0.938 | low density | 23 | 0.916 | 30/70 | 4.97 | 8.3 | 3.3 |
| Comparative ex. 4 | — | — | — | high density<br>low density | 35<br>23 | 0.960<br>0.916 | 0/100 | 0 | 7.0 | 2.6 |
| Comparative ex. 5 | 20/7.53 | 20 | 0.941 | — | — | — | 100/0 | 7.53 | 7.4 | 3.9 |

*The values of vinyl acetate content are those before saponification. Those shown in Table are saponified to 80% saponification degree in use.

TABLE 7

(Spinning condition and physical properties)

| | Spinning condition | | | | | | | |
|---|---|---|---|---|---|---|---|---|
| | Spinning | Spinning Temperature first component / second component | Delivery velocity | Take-up velocity | Number of holes | Diameter of holes | Draft | Mixing ratio first component / second com- |

TABLE 7-continued (Spinning condition and physical properties)

| | process | (°C.) | (g/min) | (m/min) | nozzle | of nozzle | ratio | ponent |
|---|---|---|---|---|---|---|---|---|
| Example 21 | side-by-side | 300/200 | 64 | 900 | 240 | 0.6 | 880 | 50/50 |
| Example 22 | " | 300/200 | 84 | 900 | 240 | 0.6 | 670 | 50/50 |
| Example 23 | " | 300/200 | 60 | 500 | 80 | 1.5 | 1,110 | 30/70 |
| Example 24 | " | 320/200 | 84 | 900 | 240 | 0.6 | 670 | 50/50 |
| Example 25 | Sheath (EVA) Core (PP) | 320/230 | 64 | 450 | 240 | 1.5 | 2,750 | 50/50 |
| Example 26 | side-by-side | 320/200 | 64 | 1,400 | 80 | 1.5 | 2,870 | 70/30 |
| Comparative ex. 2 | " | 300/200 | 144 | 450 | 240 | 0.6 | 200 | 50/50 |
| Comparative ex. 3 | " | 300/200 | 144 | 850 (limit) | 240 | 0.6 | 370 | 50/50 |
| Comparative ex. 27 | " | 320/200 | 72 | 900 | 470 | 0.75 | 2,390 | 60/40 |
| Comparative ex. 28 | " | 300/200 | 74 | 750 | 240 | 0.6 | 630 | 50/50 |
| Comparative ex. 4 | " | 300/250 | 144 | 450 | 240 | 0.6 | 200 | 50/50 (PE) |
| Comparative ex. 5 | " | 300/200 | 80 | 690 (limit) | 240 | 0.6 | 540 | 50/50 |

| | Physical properties of fibers | | | | | | Physical properties of non-woven fabrics | |
|---|---|---|---|---|---|---|---|---|
| | Denier | Number of crimps wave/ 25 mm | Strength (g/d) | Elongation (%) | Percent cross-sectional circumference (%) | (MFR of 2nd component / MFR of 1st component = ratio of melt flow rate) | Tensile strength (Kg/20mm) | Percent shrinkage heating temperature 145° C. (%) |
| Ex. 21 | 2.7 | 0 | 1.5 | 220 | 73 | $\left(\frac{44.6}{14.3} = 3.1\right)$ | 20 | 0 |
| Ex. 22 | 3.5 | 0 | 1.1 | 350 | 63 | $\left(\frac{32.9}{14.3} = 2.3\right)$ | 19 | 0 |
| Ex. 23 | 13.5 | 0 | 1.3 | 290 | 79 | $\left(\frac{36.8}{14.3} = 2.6\right)$ | 17 | 0 |
| Ex. 24 | 3.5 | 0 | 1.2 | 330 | 82 | $\left(\frac{53.3}{13.8} = 3.9\right)$ | 22 | 0 |
| Ex. 25 | 5.3 | 0 | 2.5 | 90 | 100 | (Sheath and core spinning) | 21 | 0 |
| Ex. 26 | 5.1 | 0 | 2.4 | 100 | 53 | $\left(\frac{33.2}{13.8} = 2.4\right)$ | 22 | 0 |
| Comparative ex. 2 | 3.0 | 8 | 3.3 | 37 | | — | 21 | 2 |
| Comparative ex. 3 | 6.4 | 0 | 0.5 | 650 | | — | 10 | 0 |
| Ex. 27 | 1.5 | 1 | 2.6 | 90 | 61 | $\left(\frac{38.7}{13.8} = 2.8\right)$ | 24 | 0 |
| Ex. 28 | 3.7 | 0 | 0.7 | 540 | 71 | $\left(\frac{48.2}{16.2} = 3.0\right)$ | 16 | 0 |
| Comparative ex. 4 | 3.0 | 0 | 3.4 | 32 | 67 | | — | — |
| Comparative ex. 5 | 4.4 | 0 | — | — | | — | — | — |

COMPARATIVE EXAMPLE 2

The polypropylenes obtained by polymerization were pelletized without adding a peroxide, at a resin temperature of 270° C. with a 65 mmϕ extruder to obtain the polypropylene pellets having a MFR of 7.3 and a Q-value of 6.4. The unstretched filaments obtained by spinning from a first component of polypropylene and second components shown in Table 6 under the condition shown in Table 7 were stretched at a roll temperature of 100° C. 4 times the original length to give stretched filaments of 3 denier. Resultant composite fibers created crimps of 8 per 2.54 cm. It was difficult to short cut these fibers to about a length of about 5 mm. On this account, it was impossible to use these fibers as raw materials for paper making.

COMPARATIVE EXAMPLE 3

The first and the second components used in Comparative example 2 were arranged into side-by-side type composite fibers in a component ratio of 50/50 by using the same nozzle as in Comparative example 2 and fixing a delivery velocity of gear pump at 144 g/min while gradually increasing take-up speed in order to determine the limit of take-up speed which allows stabilized spinning whereby a speed of 850 m/min was obtained.

The conditions at this time and the physical properties of fibers are shown in Table 7.

EXAMPLE 27

To the polypropylene powder having a MFR of 0.74 and a Q-value of 4.3, 0.07% of dicumyl peroxide was added and pelletizing was carried out at a temperature of 300° C. to obtain the polypropylene having a MFR of 21 and a Q-value of 2.2. By using the resultant polypropylene as a first component and the second components indicated in Table 6, composite spinning was carried out under the condition shown in Table 7 whereby resultant composite fibers showed the physical properties shown in Table 7.

EXAMPLE 28

To the polypropylene powder having a MFR of 2.2 and a Q-value of 5.7, 0.006% by weight of 2,5-dimethyl-2,5-ditertiarybutyl peroxyhexane as a peroxide was added and pelletization was carried out at a temperature of 280° C. with a 65 mmϕ extruder to obtain the polypropylene pellets having a MFR of 8.3 and a Q-value of 3.3. The physical properties of the composite fibers obtained from resultant polypropylene as a first component and the second components indicated in Table 6 under the condition indicated in Table 7 were as shown in Table 7.

COMPARATIVE EXAMPLE 4

By arranging the polypropylene component used in Example 21 and the polyethylene component consisting of 50% by weight of the high density polyethylene having a MI of 35 and a density of 0.960 g/cm$^3$ and 50% by weight of the low density polyethylene having a MI of 23 and a density of 0.916 g/cm$^3$, in the side-by-side relationship with the proportion of the two components of 50/50 to effect composite spinning under the condition shown in Table 7. Resultant unstretched filaments were stretched 4 times the original length at a roll temperature of 100° C. to obtain 3 denier stretched filaments. Resultant stretched filamets had no crimps and used as a sample for paper-making.

COMPARATIVE EXAMPLE 5

To the polypropylene powder having a MFR of 1.9 and a Q-value of 6.2, 0.004% by weight of 2,5-dimethyl-2,5-ditertiarybutyl peroxide was added as a peroxide and pelletizing was carried out at a temperature of 280° C. with a 65 mmϕ extruder to obtain polypropylene pellets having a MFR of 7.4 and a Q-value of 3.9. By using resultant polypropylene as a first component and the EVA shown in Table 6 as a second component and the spinning condition of Table 7 and fixing a delivery velocity of gear pump at 80 g/min while gradually increasing take-up speed in order to determine the limit of take-up speed which allows stabilized spinning whereby a speed of 690 was obtained. The draft ratio at this time was 540. Physical properties of resultant fibers are shown in Table 7.

EXAMPLES FOR PAPER MAKING

The composite fibers of Examples 22 and 24 and Comparative example 4, were short-cut into a fiber length of about 5 mm in order to use them in paper making as raw materials. After blending of paper raw materials, paper making was carried out according to the method of JIS P8209. Papers having a basis weight of about 50 g/m$^2$ was prepared by drying at a dryer temperature of 95° C. The physical properties of resultant papers are shown in Table 8. It can be observed that the physical properties of the paper obtained by using the composite fibers were by for the best.

TABLE 8

(Paper-making test)

| Example of paper making | Formulation of paper raw materials (%) | | | | | Physical characteristic properties of paper incorporated with PP | | | | | |
|---|---|---|---|---|---|---|---|---|---|---|---|
| | | | | | | Tensile strength (Kg/15 mm) | | Breaking length (Km) | | Peeling strength (g/15 mm) Heat seal condition | |
| | PP type fibers | | Rayon | NBKP** | PVA | dry | wet | dry | wet | 140° C. 0.5 sec. | 180° C. 0.5 sec. |
| 1 | Example 22 | 30 | — | 70 | — | 2.99 | 0.361 | 3.91 | 0.472 | 120 | 180 |
| 2 | Example 24 | 30 | — | 70 | — | 3.17 | 0.415 | 4.23 | 0.565 | 160 | 210 |
| 3 | Comparative example 4 | 30 | — | 70 | — | 1.78 | 0.062 | 2.24 | 0.084 | 6 | 41 |
| 4 | PP fiber (3d)* | 30 | — | 70 | — | 1.40 | 0.048 | 1.91 | 0.062 | 0 | 5 |
| 5 | Example 22 | 30 | 30 | 35 | 5 | 2.98 | 0.373 | 4.05 | 0.488 | 170 | 190 |
| 6 | Example 24 | 30 | 30 | 35 | 5 | 3.46 | 0.416 | 4.52 | 0.555 | 180 | 200 |
| 7 | Comparative example 4 | 30 | 30 | 35 | 5 | 1.85 | 0.071 | 2.47 | 0.097 | 14 | 72 |
| 8 | PP fiber (3d)* | 30 | 30 | 35 | 5 | 1.64 | 0.051 | 2.33 | 0.064 | 0 | 15 |
| 9 | Example 22 | 50 | — | 50 | — | 2.93 | 0.357 | 3.83 | 0.467 | 210 | 230 |
| 10 | Example 24 | 50 | — | 50 | — | 3.24 | 0.391 | 4.07 | 0.521 | 230 | 250 |
| 11 | Comparative example 4 | 50 | — | 50 | — | 1.40 | 0.029 | 1.86 | 0.040 | 18 | 110 |
| 12 | PP fibers (3d)* | 50 | — | 50 | — | 0.82 | 0.010 | 1.12 | 0.014 | 0 | 50 |

*Common single polypropylene fibers
**one kind of Kraft pulp

What is claimed is:

1. Heat-adhesive composite fibers having a denier within the range of 1–20, and comprising (a) a first component of crystalline polypropylene, and P1 (b) a second component consisting of a polymer mixture composed of (1) a saponification product of an ethylene-vinyl acetate copolymer and (2) polyethylene, said saponification product of an ethylene-vinyl acetate copolymer containing 0.5–18 mol % of vinyl monomer units consisting of vinyl alcohol units and vinyl acetate units based upon the total of vinyl alcohol units, vinyl acetate units and ethylene units, and having a saponification degree of 30% or more, said polymer mixture consisting of more than 70% by weight of said saponification product of an ethylene-vinyl acetate copolymer and less than 30% by weight of said polyethylene, said polymer mixture containing 0.5–18 mol % of vinyl monomer units consisting of vinyl alcohol units and/or vinyl acetate units based upon the total of vinyl acetate units, vinyl alcohol units and the total of ethylene units in said saponification product and those in said polyethylene, in the said polymer mixture, the composite ratio of said first component to said second component being in the range of 40:60 to 70:30, said first and second components being joined together along an axially extending interface, and said second component forming at least 50% of the exterior surface of the composite fibers continuously in the longitudinal direction of the fibers so as to give the composite fibers heat-adhesive properties.

2. Heat adhesive composite fibers according to claim 1 wherein said components are arranged in either a side-by-side or a sheath-and-core manner.

3. Heat adhesive composite fibers according to claim 1 wherein the Q value of crystalline polypropylene is not greater than 3.5.

4. Heat adhesive composite fibers according to claim 1 wherein the specific density of said second component is not greater than 0.93.

5. Heat adhesive composite fibers according to claim 1 wherein the second component has a circumference percentage of the fiber cross-section of not smaller than 50%.

6. Heat adhesive composite fibers according to claim 1 wherein the melt-flow rate of said second component is 1 to 6 times that of said first component.

7. Heat adhesive composite fibers according to claim 1 wherein the melt-flow rate of said second component is 1.5 to 5 times that of said first component.

* * * * *